United States Patent [19]

Backus

[11] Patent Number: 4,576,378

[45] Date of Patent: Mar. 18, 1986

[54] GOLF PRONATION TRAINING DEVICE

[76] Inventor: George S. Backus, 745 Hillrise Pl. NE., Bremerton, Wash. 98310

[21] Appl. No.: 620,036

[22] Filed: Jun. 13, 1984

[51] Int. Cl.[4] ..... A63B 69/36

[52] U.S. Cl. ..... 273/186 A; 273/194 R; 273/186 C

[58] Field of Search ..... 273/167 E, 194 R, 186 A, 273/194 A; 441/60, 63, 76; 244/35 R, 155 A; 272/130, 116

[56] References Cited

U.S. PATENT DOCUMENTS

| | | | |
|---|---|---|---|
| 1,536,512 | 5/1925 | McLaren | 273/192 |
| 2,169,774 | 8/1939 | Taylor | 273/167 E X |
| 2,986,937 | 6/1961 | Chapman | 273/194 R X |
| 3,142,485 | 7/1964 | Jacobsen | 272/116 |
| 3,463,492 | 8/1969 | White | 273/72 |
| 3,565,444 | 2/1971 | LaRocca | 273/186 A |
| 3,595,577 | 7/1971 | Hodge | 273/167 E |
| 3,719,363 | 3/1973 | Harrison | 273/186 A |
| 3,758,117 | 9/1973 | Harrison | 273/186 A |
| 3,776,556 | 12/1973 | McLaughlin | 273/186 A |
| 3,809,397 | 5/1974 | Gruenewald | 273/26 |
| 3,829,102 | 8/1974 | Harrison | 273/186 A |
| 4,195,439 | 4/1980 | Kramer | 244/35 R X |
| 4,416,451 | 11/1983 | Solloway | 272/130 X |

FOREIGN PATENT DOCUMENTS

| | | | |
|---|---|---|---|
| 2060405 | 5/1981 | United Kingdom | 273/186 A |

*Primary Examiner*—George J. Marlo

*Attorney, Agent, or Firm*—Christensen, O'Connor, Johnson & Kindness

[57] ABSTRACT

Golf pronation training device (10) is composed of a thin, flat airfoil (18) and a pair of flanges (21) formed with slotted bores (30) for receiving therein a shaft of a golf club. A plurality of thumbscrews (42) extend through the flange (21) to engage insert members (44) mounted on the flanges to lock the golf club shaft within bore (30) at a selected location along the length of the shaft and at desired angular orientation relative to the face of the club shaft. The effective area of airfoil (18) may be altered by selectively removing plugs (58) disposed within circular openings (56) spaced about the area of the airfoil. The training device (10) imparts a progressively increasing torque load on the club during the down swing tending to rotate the club head relative to the longitudinal axis of the club shaft to facilitate proper pronation of the golfer's hands. After the club strikes the ball, the continued rotation of the airfoil (10) results in a rapid decline of the air drag, thus enhancing the tendency of the golfer to follow through with his swing.

12 Claims, 5 Drawing Figures

GOLF PRONATION TRAINING DEVICE

TECHNICAL FIELD

The present invention relates to the game of golf, and more particularly to a training device for assisting golfers in achieving and retaining the correct wrist/hand pronation required for a proper golf swing.

BACKGROUND OF THE INVENTION

A successful golf swing is composed of a complex but precise interaction of many components, including proper stance and address of the ball, grip of the club handle, speed of the backswing, position and lack of movement of the head, placement of the rear elbow relative to the body, forward rotation of the hips during the initial portion of the downstroke, pronation of the wrist and hands during the downstroke and as the club strikes the ball, and followthrough. Even a minor variation in any of these components can drastically alter the direction and length of travel of the golf ball. Not surprisingly, the swing of almost all golfers is less than optimal. Perhaps the most universal problem of golfers is the tendency to "slice" or "push" the ball so that the ball curves to the right (for a right-handed golfer) rather than traveling in a straight line. The most common causes of a slice include the swinging of the club in an "outside-in" arc and the improper or lack of pronation of the wrists during the swing. Other golfers suffer from an excessive hook swing causing the ball to travel to the left of the center of the fairway. The usual causes of the hook swing are an overly pronounced "inside-out" swing and excessive pronation of the wrists during the down swing and when striking the ball.

In the past, numerous devices have been developed to assist a golfer to achieve a proper swing. One such type of device is composed of an elongated arm extending upwardly from a horizontal carrier arm clamped to the lower portion of the club shaft. A plurality of vertically spaced apart openings are formed in the upright arm to receive a chord or a flexible line through one of the openings. The ends of the chord are anchored by front and rear pins so that the chord forms a straight line at right angles to the club face. This training device is designed to retain the golf club in a straight line as the club is swung rearwardly and then forwardly to strike the ball. While this device may be of some value in assisting a golfer to develop a correct stroke for putting, it cannot be employed in conjunction with irons or woods. An example of this type of training device is disclosed in U.S. Pat. No. 1,536,512.

Another type of golf swing training device is composed of a wing-shaped member having two planar surfaces separated by a central U-shaped channel portion that is clamped to the shaft of a golf club so that the planar surfaces are disposed transversely to the club face. The device generates a substantial amount of air drag during the initial portion of the downstroke. However, the air drag progressively decreases during the down swing as the club head is rotated forwardly, with the drag reaching a minimum at the point that the club head strikes the golf ball. Thereafter, the drag progressively increases during the follow-through. An example of this type of training device is disclosed by U.S. Pat. No. 3,565,444.

Another type of golf swing training device, which is designed to produce an audible sound when the golf club is improperly swung, is disclosed by U.S. Pat. No. 3,776,556. The device is formed with a teardrop-shaped body that is mounted on the lower portion of a club shaft by a bracket assembly so that the larger end of the body is positioned forwardly. Diagonal passageways extend from one side surface to the opposite side surface of the body in crisscross fashion. A relatively low pitched whistle is disposed in one passageway while a relatively high pitched whistle is disposed in the other. The entrances of the passageways are positioned with respect to the larger forward end of the body so that, in theory, movement of the body along its longitudinal axis causes no sound to be produced by the whistles, but motion of the body along a line oblique to its longitudinal axis causes one of the two whistles to sound.

A further type of golf swing training device is constructed generally in the form of a tailwing of an airplane and is mounted to the upper surface of the head of a driver to help direct the club head during the swing. In one form of the device, a cable mechanism is provided to rotate the tailwing type member about a vertical axis to, in theory, assist in altering the lateral orientation of the club head while striking the ball. In a second form of the training device, an electrical apparatus is employed to rotate the tailwing type member relative to the club head. An example of this type of training device is disclosed by U.S. Pat. No. 3,829,102.

SUMMARY OF THE INVENTION

Based on the results of various testing programs conducted by the inventor, the golf pronation training device of the present invention is constructed with a thin, planar airfoil mountable on the shaft of any type of a golf club, whether a wood or an iron to extend transversely from the shaft. The training device is formed with enlarged thickness flanges disposd along the forward edge of the airfoil. Slotted bores extend longitudinally through the flanges for reception of the club shaft. The training device may be placed at a desired location along the length of the club shaft and at a desired angular orientation about the axis of the club shaft. Hardware members or other appropriate means may be employed to securely lock the club shaft within the bores once the training device is positioned at the selected location on the club shaft.

When the training device is positioned so that the plane of the airfoil is generally parallel to the club face but extending from the shaft in a direction opposite to the direction of the club head, applicant has found that the training device automatically causes the golfer both to swing in an inside-out arc and to pronate his hands thus reducing the tendancy of the golfer to slice the ball while increasing the distance that the ball travels down the fairway. Correspondingly, when the airfoil is positioned to be generally parallel to the club face and extending in the same direction of the club head, the training device of the present invention reduces the tendency of the golfer to hook the ball.

In use, when the training device is mounted on the club shaft to extend away from the club head, the device does not affect the back swing since the club head is moving at a relatively slow speed. Also during the initial stages of the down swing the airfoil is disposed substantially parallel to the arc of the swing and thus the effective area of the airfoil (the area of the airfoil perpendicular to the travel path of the airfoil) is quite small. As a result during this portion of the down swing, the airfoil imparts very little drag resistance to the club.

However, as the club moves further along the down swing, both the effective area of the airfoil and the speed of the club head progressively increase, thereby imparting an increasing torque load on the shaft tending automatically to rotate the club shaft about its longitudinal axis and in the forward direction relative to the arc of the swing. Thus, as long as the golfer's wrists are reasonably relaxed, the torque load generated by the airfoil will result in the automatic pronation of the golfer's hands as required in a proper swing to prevent a slice and to maximize the distance that the ball is hit.

Also, as the club head strikes the ball and the club continues along its path, the torque load imposed on the shaft by the airfoil tends to cause the golfer to continue to rotate his hands and wrists forwardly so that the club head is properly driven through the ball. This continued rotation of the golfer's hands and wrists in turn results in a relatively rapid decrease in the effective area of the airfoil thus quickly reducing the air pressure on the airfoil and thus the drag on the club which helps foster a proper follow-through.

The angular orientation of the airfoil relative to the club face can be selectively altered thereby to vary the effective area of the airfoil and thus the magnitude of the air pressure that acts against the airfoil. This enables the level of torque load imposed on the club shaft by the training device and thus the level of pronation assist to be adjusted to the physical characteristics of the user.

In a further aspect of the present invention, a plurality of openings are formed in the airfoil, which openings are occupied by removable plugs. The golfer can also conveniently change the effective area of the airfoil by selectively removing the plugs, which in turn alters the level of drag and the torque load imposed on the golf club during the golf down swing.

BRIEF DESCRIPTION OF DRAWINGS

The details of a typical embodiment of the present invention will be described in connection with the accompanying drawings, in which.

DETAILED DESCRIPTION

Figure 1:
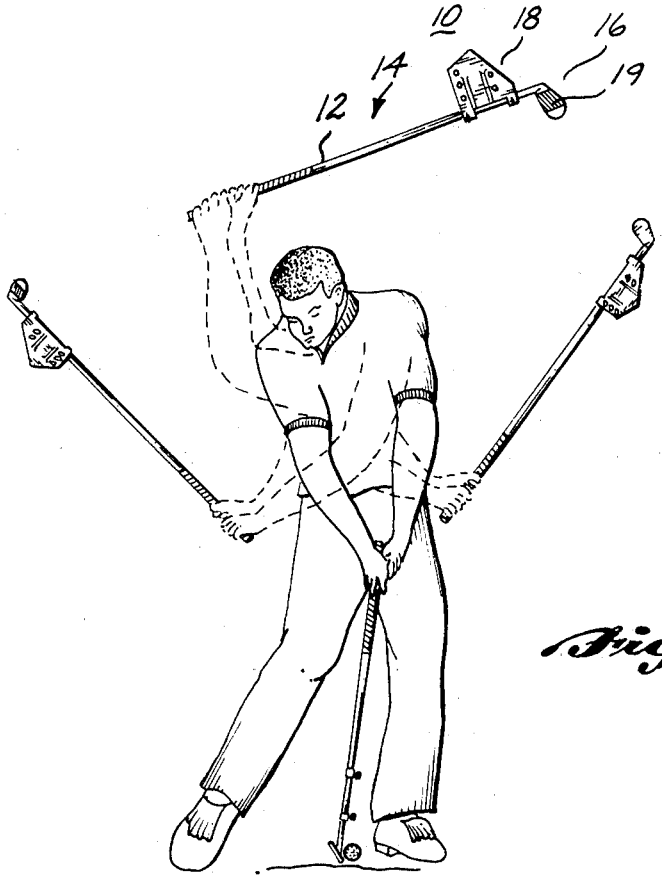
FIG. 1 is an isometric view of the golf pronation training device of the present invention illustrated as mounted on a golf club, with the club being gripped by a golfer and shown in various positions along a golf swing.
Figure 2:
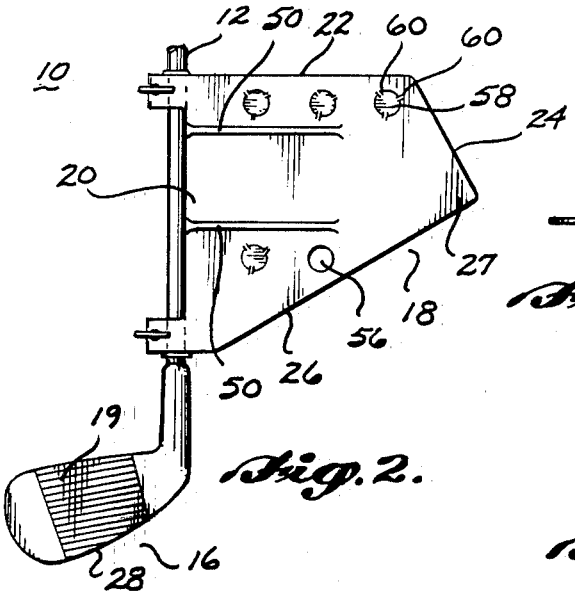
FIG. 2 is a side elevational view of the present invention.
Figure 3:
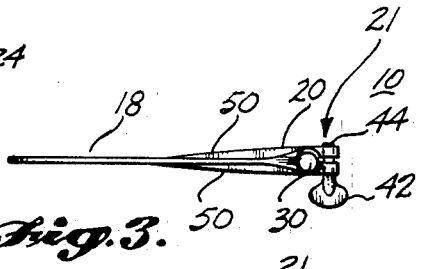
FIG. 3 is a top view of the present invention illustrated in FIG. 2.

Referring initially to FIGS. 1, 2, and 3, a golf pronation training device 10 of the present invention is illustrated mounted on shaft 12 of a conventional golf club 14 at the lower end of the shaft adjacent the head 16 of the club. Although club 14 is illustrated in the FIGURES as an iron, it is to be understood that it also can be used with woods. Pronation training device 10 in basic form is composed of an airfoil 18 formed as a thin, flat, generally quadrilateral shaped member. The airfoil is constructed with an enlarged thickness forward or attachment edge portion 20. Apertured flanges 21 extend forwardly from the upper and lower portions of forward edge portion 20 to attach training device 10 to shaft 12, as more fully discussed below. Airfoil 18 includes an upper edge portion 22 extending generally transversely to forward edge portion 20, a rear edge portion 24 that slopes downwardly and outwardly from the upper edge portion and a lower edge portion 26 that extends upwardly and rearwardly from the bottom of the forward edge portion to intersect the rear edge portion at the rearmost portion of the airfoil to define a tip portion 27. The angular orientation of the lower edge portion of the airfoil relative to shaft 12 generally corresponds to the angular relationship between the lower edge 28 of club head 16 and the shaft. Sloping the lower edge portion 26 of the airfoil in this manner prevents the airfoil from striking the ground during the lower stages of the backswing and down swing, when the club head is nearest the ground.

Although airfoil 18 is preferably shaped in the manner described above and illustrated in FIGS. 1–3, it is to be understood that the airfoil can be formed in other shapes, such as semicircular, without departing from the spirit or scope of the present invention.

As noted above, the golf pronation training device of the present invention is mounted on club shaft 12 by flanges 21 which are formed with a thickness substantially greater than the thickness of the remainder of airfoil 18. Aligned circular bores 30 extend through the flanges to receive the club shaft therein. A slot 32 extends inwardly through flanges 21 to intersect bores 30 to form flanges halves 34 and 36 to enable shaft 12 to pass there between during engagement within and removed from the bore. A second smaller slot 37 extends along the entire height of edge portion 20 and intersects circular bores 30 at locations diametrically opposite to slots 32. It will be appreciated that smaller slot 37 increases the flexibility of the flange halves 34 and 36 so that they can be easily spread apart when mounting training device 10 on shaft 12 and when removing the training device from the shaft.

Preferably, airfoil 18 is constructed from a tough but flexible material to enable the flange halves 34 and 36, located on the opposite sides of slot 32, to flex sufficiently to permit passage of shaft 12 through slot 32 Also, ideally the airfoil is constructed from light weight material to avoid appreciably altering the weight characteristics of the club. Examples of possible materials meeting these requirements include, for instance, polyvinylchlorides, polycarbonates and polystyrenes, such as acrylonitrite butadiene styrene. It is to be understood, however, that airfoil 18 may be constructed from other types of materials besides these examples.

A curved, tapered section 38 provides a smooth transition between the thinner airfoil 18 and the thicker flanges 21. This enables transfer of the torque and shear loads generated by the reaction of airfoil 18 with the air between the airfoil and flanges 21 while minimizing the likelihood that stress risers may develop at the intersection of these portions of training device 10.

Figure 4:
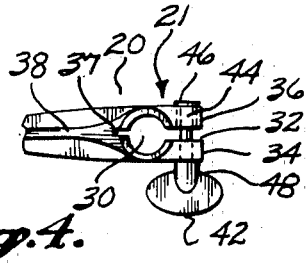
FIG. 4 is an enlarged fragmentary top view of the present invention.

Referring additionally to FIG. 4, training device 10 is maintained in selected longitudinal position on shaft 12 and angular orientation relative to club head 16 by fasteners in the form of thumbscrews 42 which extend through close fitting clearance openings formed in flange half 34 to engage internally threaded insert members 44 that are snugly disposed within aligned openings formed in flange half 36. Insert members 44 may be constructed with enlarged head portions 46 to bear against the outer surface of flange half 36. Likewise, preferably thumbscrews 42 are constructed with enlarged shoulder portions 48 to provide a sufficiently large bearing surface for seating against the outside surface of flange half 34 without disfiguring the flange when the thumbscrews are being tightened or loosened. Alternatively, flat washers, not shown, may be placed between thumbscrews 42 and the flange half to provide a proper bearing area.

It is to be understood that insert members 44 may not be required if the material used to construct training device 10 possesses the proper physical characteristics to enable screw threads to be formed directly in flange half 36 of sufficient strength to carry the loads imposed on the threads by thrumbscrews 42. Moreover, other types of fasteners and fastening arrangements may be used in place of thumbscrews 42 and insert members 44 without departing from the scope of the present invention. In addition, although two thumbscrews 42 and insert members 44 are illustrated in the drawings, additional hardware members may be employed if required to maintain the club shaft stationary relative to flanges 21.

As most clearly illustrated in FIGS. 2 and 3, a pair of vertically spaced-apart stiffening webs 50 extend transversely from the surfaces of airfoil 16 on both sides of the airfoil. The webs are employed to enhance the rigidity of the airfoil, and also to assist in transmitting bending and shear loads between the airfoil and flanges 21. Each web 50 extends rearwardly from forward edge portion 20 to a location approximately midway along the length of the airfoil. Of course, the length of the web may be varied depending on the flexibility characteristics of the material used to manufacture the airfoil and the desired stiffness of the airfoil sought to be achieved. It will be appreciated that although two webs 50 are illustrated, the number and spacing of the webs may be varied to achieve the desired stiffness of the airfoil.

As shown in FIG. 2, airfoil 18 is constructed with a plurality of circular openings 56 arranged about airfoil 18 in a pair of rows. A close fitting plug 58 is disposed within each opening 56, which plug is retained within a corresponding opening by a plurality of narrow tie portions 60 spaced about the circumference of the openings. Preferably, plugs 58 are integrally constructed with airfoil 18 and then openings 56 produced by lancing or stamping the airfoil, except at tie portions 60, to define plugs 58. The effective area of the airfoil may be altered by removing plugs 58 as desired such as by imparting a sharp blow to the plugs with a common household tool, such as a hammer.

Figure 5:
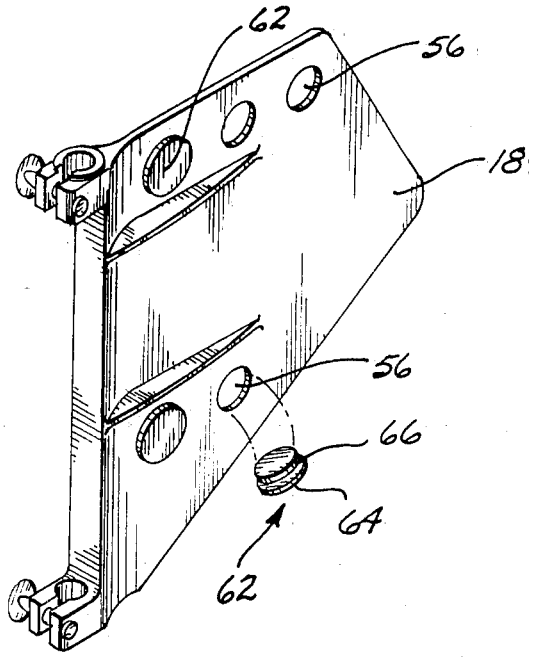
FIG. 5 is an enlarged isometric view of an alternative embodiment of the present invention specifically illustrating the use of plugs to fill openings formed in the airfoil of the present invention.

It will be appreciated that plugs to fill openings 56 may be constructed independently of the airfoil and then pressed within the openings as desired. Such plugs 62, FIG. 5, can be formed with a head portion 64 of a diameter slightly larger than the diameter of openings 56 and with a shoulder portion 66 which snugly engages within the openings.

To utilize the training device of the present invention, thumbscrews 42 are removed from attachment edge portion 20 and then flange halves 34 and 36 flexed to engage club shaft 12 within bores 30 of flanges 21. The thumbscrews are then replaced and engaged with insert members 44 to clamp the training device in the desired location along shaft 12 and in the desired angular orientation relative to the head of the club. Applicant has discovered that when the training device is positioned at the lower end of a golf club adjacent the head, the air drag generated against the airfoil 18 during the down swing imparts a torque load on the club shaft which reduces the tendancy to slice or hook the ball depending on the angular position of the airfoil. When oriented so that the tip portion 27 of airfoil 18 extends away from the club head, as shown in FIG. 2, the training device corrects a slice. Conversely, when oriented so that the tip portion 27 extends from the club shaft in the same direction as the club head, the training device corrects a hook swing.

Initially considering the training device positioned to correct a slice, during the backswing, because the club is being moved rather slowly, airfoil 18 does not hinder or otherwise effect the movement of the club. At the maximum back swing position, the plane defined by airfoil 18 is substantially parallel to the plane of the arc defined by the club head during the down swing. However, as the club travels downwardly during the down swing the natural rotation of a golfer's hands rotates the club and thus the airfoil so that its effective area progressively increases. As this occurs, a corresponding increase in the drag resistance on the airfoil is generated which in turn imposes an increasing torque load on the golf club shaft that tends automatically to rotate the club forwardly, i.e., counterclockwise for a right-handed golfer. This rotation of the club in this manner, automatically pronates the golfer's hands so that the club head is at a proper angle relative to the ball when the club face strikes the ball. Applicant has found that to avoid the automatic pronation of the golfers hands produced by training device 10, the golfer must intentionally and vigorously resist the "action" of the training device.

The angular orientation of airfoil 18 may be varied relative to the club face to accommodate the physical characteristics of a golfer. For instance, if the golfer has rather weak wrists, it is desirable that training device be rotated "forwardly" so that tip portion 27 extends in the direction forwardly of the club face relative to the first edge portion 20 of the airfoil. Orienting the training device in this manner increases the effective area of the airfoil during the initial portion of the down swing so that the training device "takes-effect" at an earlier stage of the down swing.

Conversely, for a golfer with relatively strong wrists, the training device preferably is positioned so that tip portion 27 of the airfoil is rotated somewhat rearwardly from the face of the club relative to the first edge portion 20 of the airfoil so that the effect of the training device is reduced during the later portions of the golfer's swing. A golfer with stronger wrists tends to swing the club faster than a golfer with weaker wrists and thus, unless the airfoil is rotated so that its effective area is reduced, an excessive level of torque will be applied to the club shaft tending to cause the golfer to overly hook the ball.

Also, when training device 10 is positioned generally as shown in FIG. 2, the training device of the present invention also automatically induces the golfer to swing the club head in an inside-out arc to impart a slight hook on the ball as opposed to a slice. During the down swing, if the club is swung in an outside-in manner, a larger area of the airfoil is disposed perpendicularly to the path of the club head than if the club instead is swung in an inside-out manner so that the airfoil moves somewhat sideways relative to a direction normal to the plane of the airfoil. Consequently, when the club is swung in an inside-out manner less air drag is developed than if the club is swung in an outside-in manner. Due to the natural tendency of the airfoil to move along a path of lesser resistance, the training device of the present invention induces the golfer to swing the club in an inside-out path as required for an optimum stroke.

Once the club is swung beyond the ball impact point, the high torque load being applied to the club by the training device causes the golfer's hands and the airfoil to continue to rotate and correspondingly causes a relatively quick decline in the drag load imposed on the club by airfoil 18. This rapid reduction of the drag load reinforces the golfer's tendency to properly follow through after striking the ball. For almost all golfers, a proper followthrough is needed if the golf ball is to be driven a maximum distance.

As noted previously, some golfers excessively hook the ball. This is commonly caused by an excessive amount of pronation together with an overly exaggerated inside-out swing. The present invention may be employed to correct a hook swing by orienting training device 10 so that it is disposed approximately 180° from the position shown in FIG. 2, i.e., so that tip portion 27 of the airfoil extends generally in the same direction from shaft 12 as does club 16. When the training device is placed in this orientation, it functions in a manner substantially opposite to that described above. The training device resists the excessive pronation of the golfer's wrists and also induces the club head to travel along more of an outside-in path relative to the natural inside-out path of the club head of a golfer suffering from an excessive hook swing.

Applicant has found that the use of the present invention during practice assists a golfer to achieve a proper golf swing with the necessary degree of pronation. In addition, with sufficient repetition, a mnemonic imprint on the nerve centers necessary to correct an improper swing will result. Thus, when playing a round of golf, the muscles will tend to automatically move the hands, arms and other portions of the golfer's body along the correct paths and with the proper timing to achieve a successful golf swing.

It can be appreciated that the present invention may be advantageously used during the winter months to maintain a proper golf swing even though it may not be possible to actually play a round of golf. By periodically swinging a golf club several times with the training device attached thereto, the mnemonic imprint is reinforced, so that the typical spring endeavor to reestablish the golf swing of the past season is not required.

Although FIGS. 1 and 2 illustrate the present invention mounted on a golf club for a right-handed golfer, it will be understood that the training device may be used equally effectively by both right and left-handed golfers.

As will be apparent to those skilled in the art to which the invention is addressed, the present invention may be embodied in other forms other than those specifically disclosed above without departing from the spirit or essential characteristics of the invention. The particular embodiment of the golf pronation training device and components thereof described above are therefore to be considered in all respects as illustrative and not restrictive. The scope of the present invention is as set forth in the appended claims rather than being limited to the examples of the golf pronation training device and components thereof set forth in the foregoing description.

The embodiments of the invention in which an exclusive property or privilege is claimed are defined as follows:

1. In combination with a golf club, a lightweight training device, comprising:

(a) a lightweight, thin, substantially planar, singular airfoil portion;

(b) a first, elongated, marginal side edge portion extending along one side edge of said singular airfoil portion, said side edge portion being substantially thicker than the thickness of said singular airfoil portion; and, (c) means for detachably attaching said first side edge portion to the shaft of the golf club to:

dispose said first side edge portion longitudinally adjacent the length of the golf club shaft; and, adjustably, angularly orientate said airfoil portion about the longitudinal axis of the golf club shaft alternatively between a first variable position wherein said airfoil portion extends in a selective orientation about the longitudinal axis of the golf club shaft generally in a direction opposite to and parallel to the face of the head of the golf club and a second variable position wherein said airfoil portion extends in a selective orientation about the longitudinal axis of the golf club shaft generally in the same direction as and parallel to the face of the head of the golf club thereby to selectively alter the magnitude and the direction of the torque load that is applied to the club shaft during the swinging of the club.

2. The combination of claim 1, wherein said airfoil is shaped to taper in the direction away from said first edge portion.

3. The combination of claim 1, wherein said airfoil includes a lower edge portion disposed along the portion of said airfoil directed generally toward the lower end of the club shaft, said lower edge portion being oriented relative to said first edge portion to correspond generally to the angle of inclination of the lower edge of the face of the club head relative to the length of the club shaft.

4. The combination of claim 1, wherein said airfoil includes means for varying the surface area of said airfoil portion.

5. The combination of claim 4, wherein said means for varying the surface area of said airfoil portion includes a plurality of areas partially severed from said airfoil portion wherein said partially severed areas may be removed from said airfoil portion to create openings in said airfoil portion.

6. The combination of claim 4, wherein said means for varying the surface area of said airfoil portion includes openings formed in said airfoil portion and plug members adapted to be snugly engageable within said openings.

7. The combination of claim 6, wherein said openings are spaced apart about the area of the airfoil portion.

8. The combination of claim 1, wherein said attachment means comprises:

(a) at least one pair of spaced apart flange members integrally constructed with and extending generally transversely outwardly from said first side edge portion, said flange members:

having portions defining a bore for snugly receiving and substantially encircling the golf club shaft; and, defining a first slot therebetween, said first slot extending generally radially outwardly from said bore to permit passage of the shaft of the golf club between said flange members when engaging the shaft into said bore and removing the shaft from said bore; and, (b) means for releasably pressing together said flange members to prevent angular movement of said airfoil portion relative to the golf club shaft.

9. The combination of claim 8, further comprising a second slot extending diametrically from said bore and into said first side edge portion in a direction generally opposite to said first slot.

10. The combination of claim 8, further comprising means for selectively varying the drag on said airfoil as the golf club is swung in an arc recognizable as a golf swing, said drag varying means including a plurality of areas partially severed from said airfoil portion wherein said partially severed areas are adapted to be removed from said airfoil portion to create openings in said airfoil portion.

11. The combination of claim 8, further comprising means for selectively varying the drag on said airfoil as the golf club is swung in an arc recognizable as a golf swing, said drag varying means including openings formed in said airfoil portion and plug members adapted to be snugly engaged within said openings.

12. The combination according to claim 1, wherein said airfoil portion is generally quadrilaterally shaped.

* * * * *